US006354399B1

(12) United States Patent
Austin

(10) Patent No.: US 6,354,399 B1
(45) Date of Patent: Mar. 12, 2002

(54) SLIDING RAIL ANCHOR FALL-ARREST SYSTEM

(75) Inventor: Barry J. Austin, Eagan, MN (US)

(73) Assignee: Protecta International, Inc., Houston, TX (US)

( * ) Notice: Subject to any disclaimer, the term of this patent is extended or adjusted under 35 U.S.C. 154(b) by 0 days.

(21) Appl. No.: 09/692,642

(22) Filed: Oct. 19, 2000

Related U.S. Application Data

(60) Provisional application No. 60/162,292, filed on Oct. 28, 1999.

(51) Int. Cl.[7] ..... E04G 3/14; A47B 96/06

(52) U.S. Cl. ..... 182/36; 182/3; 248/228.5

(58) Field of Search ..... 182/36, 5, 45, 182/3, 4, 10, 11, 8, 6; 248/228.5, 230.5, 229.24, 231.61, 316.6, 222.13, 222.15, 222.52

(56) References Cited

U.S. PATENT DOCUMENTS 2,765,139 A * 10/1956 White ..... 248/228.4
2,916,244 A * 12/1959 Renfroe ..... 248/228.5 X
3,111,297 A * 11/1963 Conner ..... 248/231.61 X
3,217,833 A * 11/1965 Smith ..... 182/3
3,561,717 A * 2/1971 Frederick et al. .... 248/228.5 X
3,567,169 A * 3/1971 Frederick et al. ..... 248/28.5 X
4,606,430 A * 8/1986 Roby et al. ..... 182/3
4,767,091 A * 8/1988 Cuny ..... 182/3 X
5,156,233 A * 10/1992 Olsen et al. ..... 182/3
5,526,896 A 6/1996 O'Rourke ..... 182/3
5,711,397 A * 1/1998 Flora et al. ..... 182/3
6,009,973 A * 1/2000 Woodyard ..... 182/36
6,053,279 A * 4/2000 Mc Kenna ..... 182/36
6,073,724 A * 6/2000 Wolner et al. ..... 182/3
6,148,580 A * 11/2000 Weir ..... 182/3 X
6,161,647 A * 12/2000 Braden et al. ..... 182/8

* cited by examiner

*Primary Examiner*—Daniel P. Stodola
*Assistant Examiner*—Hugh B. Thompson
(74) *Attorney, Agent, or Firm*—Mau & Krull, P.A.

(57) ABSTRACT

A sliding rail anchor assembly (22) includes a pair of anchor subassemblies (23) that latch together to slidably engage the crown (29) of a "rail" (30). Each anchor subassembly (23) includes a hook engaging portion (34) and a rail engaging portion (36). The hook engaging portion carries an inboard "post" (46) and forms a hook engaging aperture (44) and an inboard post receiving aperture (40). When the anchor subassemblies (23) are properly aligned and laterally moved together so that the hook engaging portions (34) abut, each inboard post (46) is received by the post receiving aperture (40) in the other anchor subassembly (23). Each anchor subassembly (23) also includes a latch (54) which engages the "head" (60) of the opposing inboard post (46) extending through the post receiving aperture (40). When a safety hook (24) engages hook receiving apertures (44) the latches (54) are held in their fully latched positions. A sliding rail anchor fall-arrest system (20) includes an anchor assembly (22) as described above, a safety hook (24), a safety harness (26) worn by the worker and a flexible cable (28) extending between the hook (24) and the harness (26).

11 Claims, 4 Drawing Sheets

FIG. 5
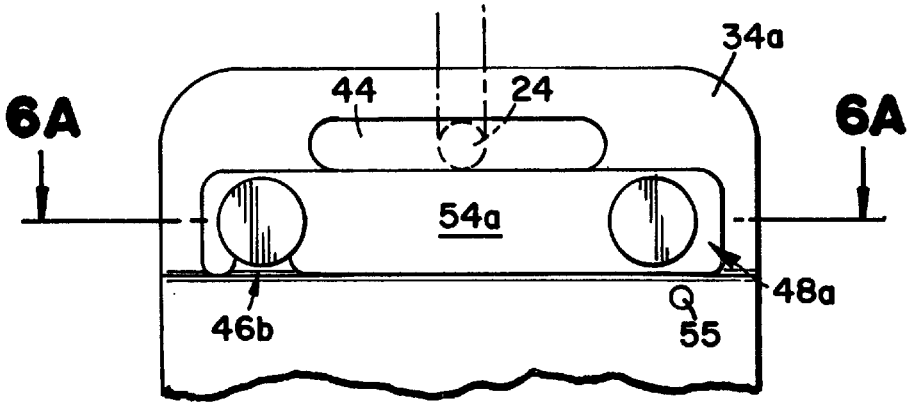
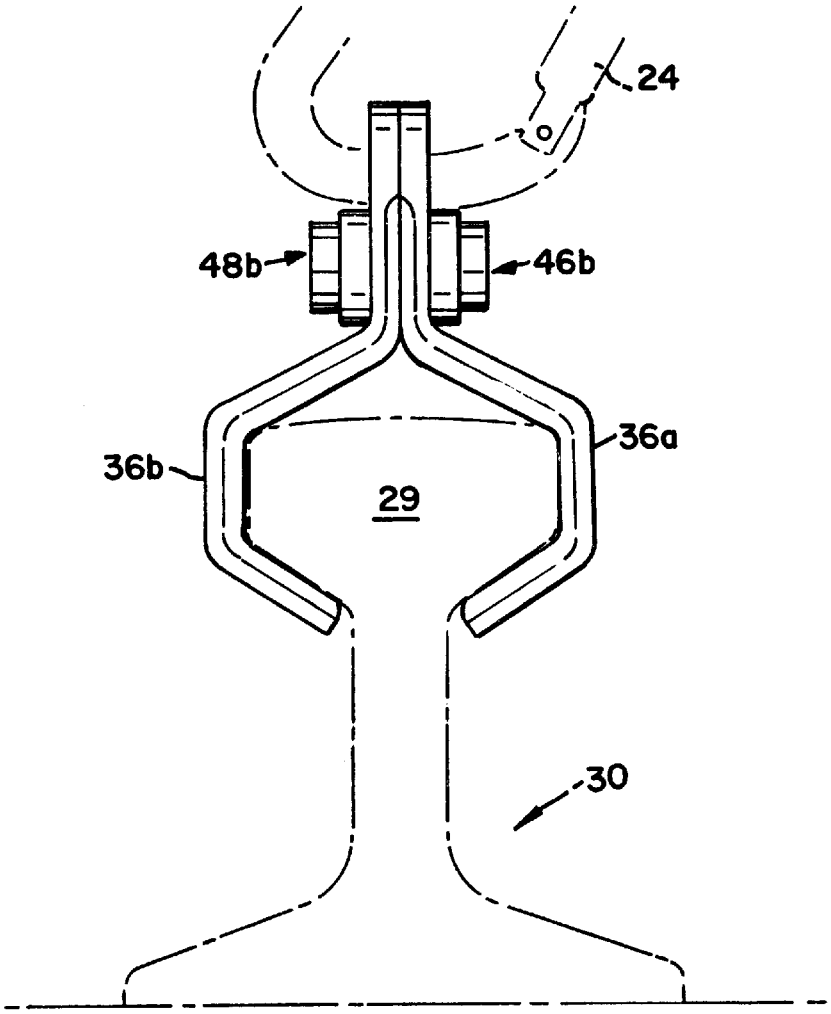
FIG. 4

FIG. 6A
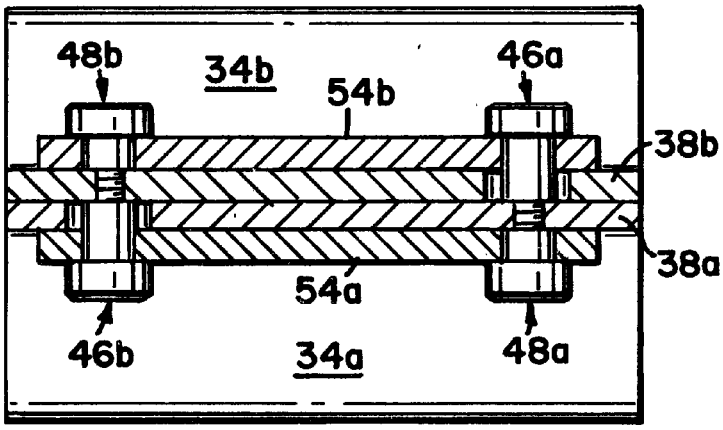
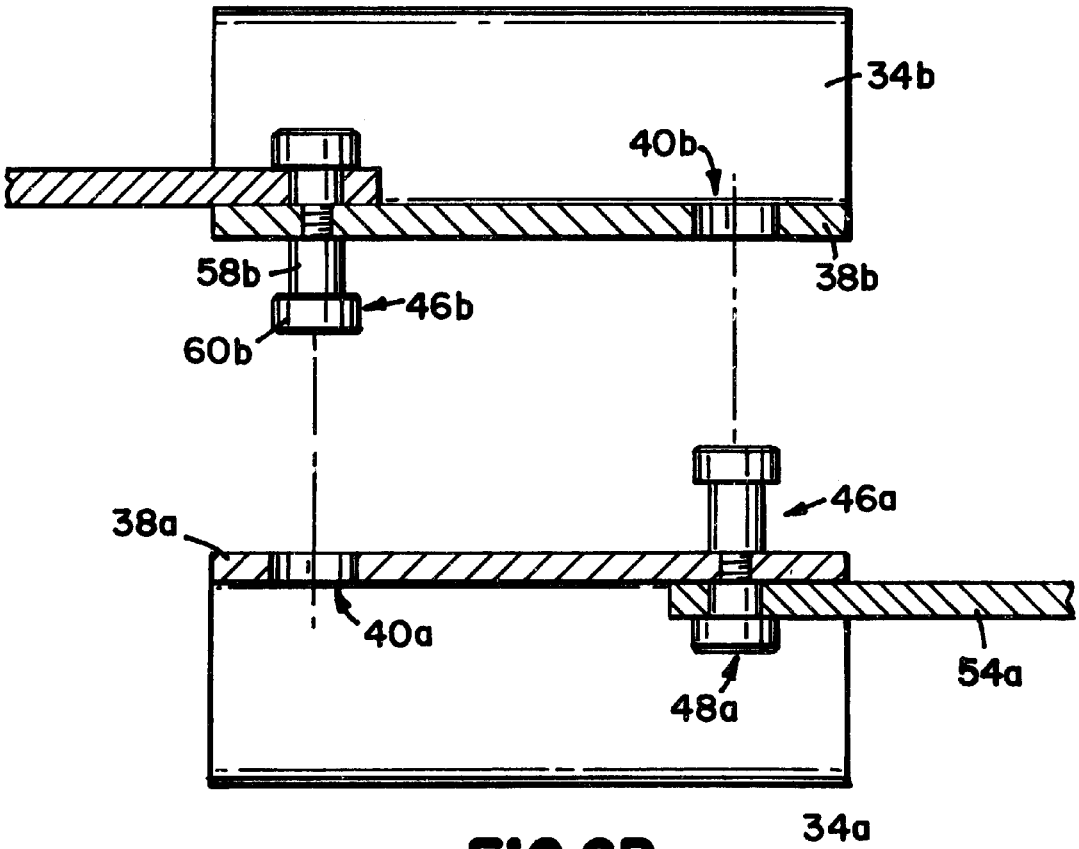
FIG. 6B

SLIDING RAIL ANCHOR FALL-ARREST SYSTEM

This application claims the benefit of U.S. Provisional Pat. application No. 60/162,292, filed Oct. 28, 1999.

BACKGROUND OF THE INVENTION

1. Field of the Invention

The present invention relates generally to fall-arrest systems, and more particularly to fall-arrest systems of the type having an anchor that are movable along a rail, e.g., a railway rail.

2. Description of the Prior Art

Fall arrest systems are well known. Such systems typically include an anchor secured to a support structure or other anchor point in the work area, a safety harness or belt worn by the worker, and a flexible cable interconnecting the anchor to the harness or belt. A fall arrest system permits the worker wearing the harness or belt to safely work in areas where he or she is subjected to the risk of falling. The fall arrest system permits the worker to conduct his or her tasks without undue interference, but should the worker fall, the system quickly and safety arrests the fall.

One type of fall arrest system includes an anchor that is movably mounted on a fixed rail, e.g. the rail of a locomotive railway. In this case, the anchor is designed to freely slide or roll along the rail so as to permit the worker to freely move along the rail to, for example, conduct maintenance activities on the railway or on a railway bridge. The anchor can slide along the rail by engaging the rail in such a way as to permit sliding in a longitudinal direction along the rail but at the same time preventing the anchor from separating from the rail or moving in a transverse direction relative to the rail. And, of course, the anchor is securely connected to the worker by means of a safety hook, a cable, and a harness or a belt.

One example of a prior art sliding rail anchor fall arrest system is disclosed in U.S. Pat. No. 5,526,896 to O'Rourke. The O'Rourke anchor includes a pair of formed metal plates each comprising an upper flat portion and a lower curved portion. The flat portions abut together and the curved portions capture and slidably engage the crown of a rail. The flat portion of each plate forms three apertures, the middle of which receives a safety hook, and the outer two of which receive threaded fasteners for holding the abutting flat portions together. One of the outer apertures on each anchor plate is elongated and has a smaller end and a larger end. The flat plates are assembled by loosely attaching the threaded fasteners to the plates; abutting the plate flat portions together so that the larger ends of the elongated holes receive the bolt heads; and longitudinally sliding one plate relative to the other plate so that the bolts then reside in the smaller ends of the elongated apertures. Once the two flat portions are slid together in this fashion, the threaded fasteners can then be tightened to adjust the fit between the anchor and the rail, establishing anything from a loose sliding fit to having the anchor actually clamped to the rail thus permitting no longitudinal movement of the anchor whatsoever.

While the O'Rourke anchor would appear to be generally useful for its intended purpose, it is perceived that it may have some disadvantages. For one thing, the O'Rourke design requires that the workers have the tools and the patience to properly adjust the fit between the anchor and the rail. Also, friction between the flat abutting portions of the plates may hinder the sliding assembly of the plates, especially if there is any corrosion, debris, ice, gravel, etc. therebetween. In addition, it may be difficult to slidably assemble the plates and adjust the tightness of the threaded fasteners when the workers are wearing heavy work gloves or when there is inadequate light. There is also the possibility, however remote, that the fasteners will be loosened excessively, to accommodate the sliding assembly of the plates, thereby potentially increasing the likelihood that the fasteners will become disengaged from the plates.

In further reference to the O'Rourke design, since the elongated apertures must be oriented in the same direction once the plates are abutted, i.e. with both of the larger ends pointed toward a first end of the plates when the plates face one another, a disadvantage of the O'Rourke design is that the two plates are not mirror images of one another, at least with regard to the elongated apertures, thus requiring each plate to be separately manufactured and stocked. In other words, room for improvement remains.

SUMMARY OF THE INVENTION

In a preferred embodiment, the present invention includes a fall arrest anchor assembly suitable for operatively engaging a "rail" and a fall arrest hook. The anchor assembly includes a pair of anchor subassemblies each including an anchor body having a hook engaging portion, a rail engaging portion, an inboard side and an outboard side; an inboard post connected to the inboard side of the hook engaging portion, wherein the inboard post includes a "head"; an inboard post receiving aperture formed in the hook engaging portion, wherein each inboard post receiving aperture receives the inboard post of the other anchor subassembly when the anchor subassemblies are aligned proximate the rail, and laterally moved together; and a latch located on the outboard side of the hook engaging portion, wherein each latch reversibly latches the inboard post head of the other anchor subassembly, whereby the anchor subassemblies are latched together and the anchor assembly is in sliding engagement with the rail.

In a preferred embodiment, the anchor subassemblies are substantially identical to one another.

Preferably each anchor subassembly further includes an outboard post connected to the outboard side of the corresponding hook attachment portion. A preferred latch has first and second ends, wherein the lever first end is pivotally connected to the outboard post and the lever second end forms a slot or notch for engaging the inboard post head of the other anchor subassembly.

In a preferred embodiment the outboard post and the inboard post of each anchor subassembly are axially aligned to one another; and the hook attachment portion can be apertured to permit the associated inboard and outboard posts to connect to one another with the anchor body sandwiched therebetween.

In a preferred embodiment, when the hook is engaged with the hook apertures the latches are locked in engagement with the inboard posts, whereby the anchor subassemblies are locked together.

The present invention also includes an entire sliding rail anchor fall-arrest system including an anchor assembly as described above, a safety hook, a harness or belt that can be worn by a worker, and a flexible cable running from the safety hook to the harness/belt.

The invention is described in greater detail below with reference to the attached Drawings.

BRIEF DESCRIPTION OF THE DRAWINGS

The invention will be further described with reference to the Drawings, wherein:

FIG. 4 is an elevational view of the anchor assembly of FIG. 2 mounted on the crown of a railway rail, and receiving a safety hook;

FIG. 5 is a partial side elevational view of the anchor assembly of FIG. 2;

FIG. 6A is a sectional view of the anchor assembly of FIG. 2, taken generally along line 6A—6A of FIG. 5, showing the latching levers in their latched positions; and FIG. 6B is a sectional partially exploded view of the anchor assembly of FIG. 2, generally illustrating an exploded version of FIG. 6A, showing the latching levers in their unlatched positions and showing how the anchor assemblies laterally engage and disengage one another.

While the invention will be described in conjunction with the illustrated embodiment, it will be understood that it is not intended to limit the invention to such embodiment. On the contrary, it is intended to cover all alternatives, modifications and equivalents as may be included with the spirit and scope of the invention as defined by the appended claims.

DETAILED DESCRIPTION OF THE PREFERRED EMBODIMENT

Figure 1:
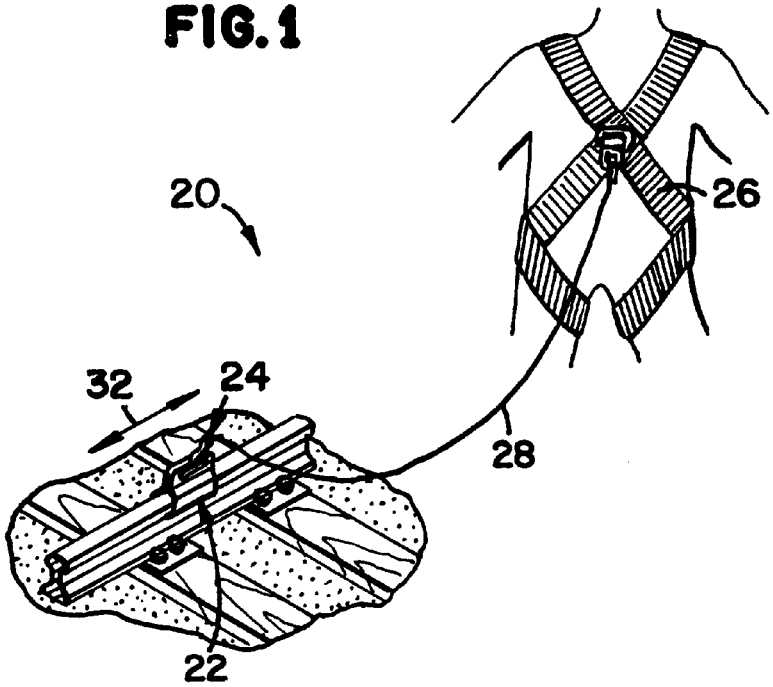
FIG. 1 is a perspective view of a fall-arrest system according to the present invention, being used in conjunction with a standard locomotive railway rail.

Referring to the drawing, wherein like reference numerals designate like parts and assemblies throughout the several views, FIG. 1 illustrates a preferred rail mounted fall-arrest system 20 in accordance with the present invention. Fall-arrest system 20 includes several main components, namely an anchor assembly 22; a safety hook or carabiner 24; a safety harness 26 worn by the worker; and a flexible cable 28 securing the safety harness 26 to the safety hook 24.

Anchor assembly 22 is, in this preferred embodiment, engaged with the crown 29 of a railway rail 30 (see FIG. 4), in such a way that anchor assembly 22 can slide longitudinally along the rail 30; while at the same time preventing anchor assembly 22 from moving in a direction transverse to the rail 30. That is, anchor assembly 22 can slide along the rail 30 as indicated by arrow 32 in FIG. 1, but cannot move in any other direction (i.e., in any "transverse" direction) relative to the rail 30. As discussed above, when referring to the longitudinal sliding motion of anchor assembly 22 on rail 30, the terms "slide" and "sliding" are used in their broadest possible sense, unless specified otherwise. Similarly, the term "rail" is not intended to be limited to the rail of a railway, but rather refers to any sort of elongate structural member to which a worker could attach an anchor assembly according to the present invention in the context of a sliding anchor fall-arrest system.

Figure 3:
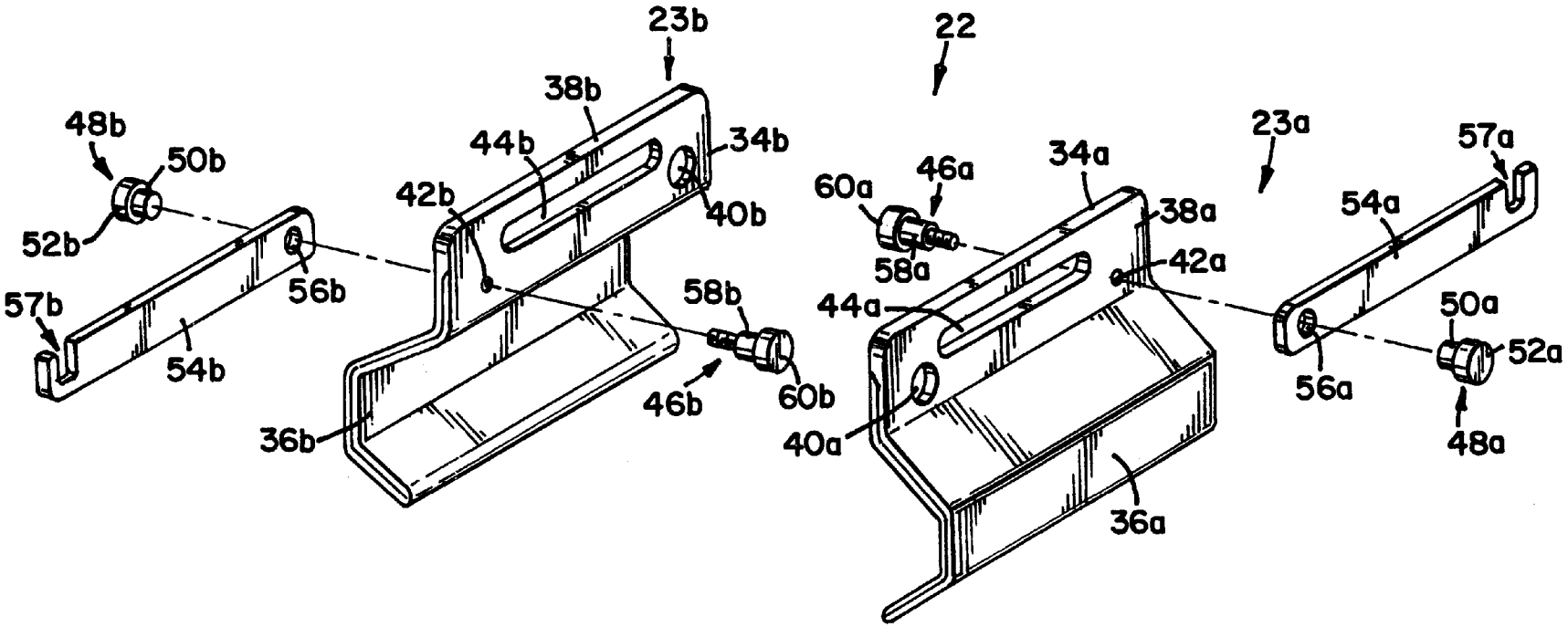
FIG. 3 is an exploded perspective view of the anchor assembly of FIG. 2.

With particular reference to FIG. 3, preferred anchor assembly 22 consists of a pair of anchor subassemblies 23. Each anchor subassembly 23 is designated "a" or "b", as are all of the components of that anchor subassembly. In the preferred embodiment, components of each anchor subassembly 23 are identical to the corresponding components of the other anchor subassembly 23, so using the "a" and "b" designations is appropriate. Each anchor subassembly 23 includes an anchor body 34*a* or *b,* and the pair of anchor bodies 34 together constitute the main structural element(s) of anchor assembly 22. Each anchor body 34 includes a three-sided rail engaging portion 36 sized and configured to slidably "capture" the crown 29 of rail 30 as shown in FIG. 4; and a hook engaging portion 38 extending therefrom. Preferably, the hook engaging portions 38 are substantially flat and rectangular, as they are designed to abut one another during assembly. Also, anchor bodies 34 are preferably constructed from steel, 0.25 inch thick gauge, which has been formed using conventional manufacturing processes. The inner edge 39 of each anchor body is chamfered to make it easier to longitudinally slide anchor assembly 22 along rail 30.

FIG. 4 illustrates anchor assembly 22 in elevation. This view clearly shows the preferred three-sided shape of the rail engaging portions 36 and how they are sized and configured to conform to the crown 29 of rail 30. Those skilled in the art will recognize that the rail engaging portions could have alternative shapes and sizes, depending on the specifics of the "rail" which the anchor assembly is designed to slidably engage. Also, it will be understood that the inner dimensions of the cavity formed by the cooperating rail engaging portions 36 are preferably slightly larger than the outer dimensions of the crown 29, to create a "sliding" fit therebetween. Again, any type of fit or system (including without limitation one that uses bearings between the anchor bodies and the rail) would fall within the term "sliding" as used herein.

Returning in particular to FIG. 3, each anchor body 34 has an inboard side, facing inwardly toward the rail (not shown in FIG. 3), and an outboard side, facing outwardly. Thus, when anchor assembly 22 is indeed assembled, the inboard sides of the hook engaging portions 38 are abutted and inboard sides of the rail engaging portions 36 form a cavity that envelopes crown 29 of rail 30 and permits longitudinal sliding but otherwise permits little if any "transverse" movement.

Referring to anchor subassembly 23*a* in FIG. 3, hook engaging portion 38*a* forms three apertures, namely an inboard post receiving aperture 40*a;* a post securing aperture 42*a;* and a hook aperture 44*a*. Extending through post securing aperture 42*a* is the relatively smaller diameter externally threaded portion of an inboard post 46*a*. Secured to the inboard post 46*a* is an internally threaded outboard post 48*a,* having a smooth shoulder 50*a* and an enlarged head 52*a*. An elongate latching lever 54*a* forms a round aperture 56*a* on one end thereof, and aperture 56*a* is sized slightly larger than shoulder 50*a* to permit latching lever 54*c* to freely pivot about outboard post 48*a*. Head 52*a* is larger in diameter than shoulder 50*a* or aperture 56*a,* thus keeping latching lever 54*a* on shoulder 50*a*. It should be noted that latching lever 54*a* is shown in FIG. 3 in its unlatched position. Also, latching lever 54*a* forms a notch 57*a* on its other end, for reasons that will be discussed below.

Referring in particular to FIG. 6B, inboard posts 46 are similar to outboard posts 48 in that each inboard post 46 includes a shoulder 58 and an enlarged head 60. Inboard post shoulder 58 is longer than outboard post shoulder 50, for reasons that will be discussed below. Inboard post head 60 is slightly smaller than inboard post receiving aperture 40, so that head 60 can freely pass through aperture 40 during assembly of anchor subassemblies 23*a* and *b,* as further discussed below.

FIG. 6B illustrates how the anchor subassemblies 23 fit together. The subassemblies are first located on either side of the crown 29 of rail 30, as generally shown in FIG. 4 (in their assembled state, however). The subassemblies 23 are then aligned with one another so that the inboard post 46*a* aligns with aperture 40*b* and inboard post 46*b* aligns with aperture 40*a;* and of course so that rail engaging portions 36*a* and *b* are properly positioned on either side of rail crown 29. Then, subassemblies 23 are simply moved toward one another (i.e., by moving both subassemblies 23 toward one another simultaneously or holding one subassembly 23 stationary while moving the other anchor subassembly 23 thereto) in a "lateral" direction. As noted above, the term "lateral" is used in this context to distinguish from a "longitudinal" motion which is along the rail as illustrated by arrow 32 in FIG. 1.

Figure 2:
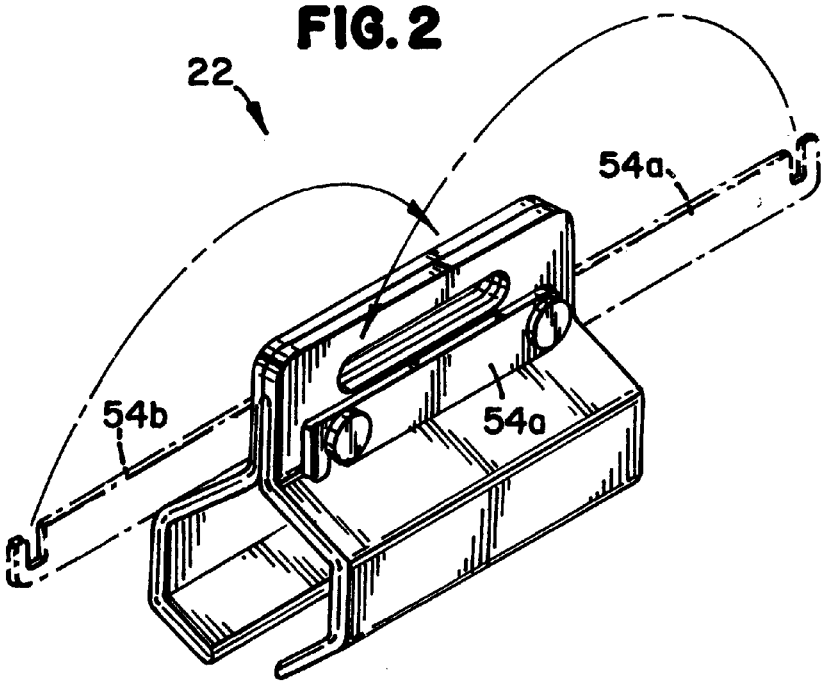
FIG. 2 is a perspective view of the anchor assembly of the fall-arrest system of FIG. 1.

As anchor subassemblies 23 are moved laterally together, each inboard post 46 passes through the opposing aperture 40. As discussed above, apertures 40 are slightly larger than inboard post heads 60, to accommodate this assembly operation. Even after the inboard post heads 60 pass through apertures 40, anchor plates 34 continue to move toward one another, until hook engaging portions 38 abut and heads 60 are located well beyond the outboard sides of the opposing anchor subassemblies. Then, latching levers 54 are pivoted as shown in FIG. 2 from their unlatched positions (FIG. 2, phantom line) to their latched positions (FIG. 2, solid line). At this point the anchor assembly 22 is firmly latched together and to the rail crown 29, with a sliding fit between anchor assembly 22 and the crown. Gravity, in this case, and to some extent friction tend to hold the latching levers 54 in their fully latched positions.

FIG. 6A shows how the shoulders of the inboard posts 46 and outboard posts 48 are sized to accommodate latching levers 54. And again, it can be seen that shoulders 58 of inboard posts 46 are roughly twice as long as shoulders 50 of outboard posts 48, since each inboard post 46 must pass completely through and beyond the opposing post receiving aperture 40.

Note that notches 57 are slightly wider than shoulders 58 so that when the latching levers 54 are pivoted as shown in FIG. 2, notches 57 can receive shoulders 58 to allow the latching levers 54 to reach their fully latched positions (horizontal in the Drawing).

Once the latching levers 54 are fully latched (horizontal in the Drawing) they do not permit the inboard posts 46 to be withdrawn from the opposing post receiving apertures 40. That is, the latching levers 54 engage the heads 60 of the inboard posts 46 to prevent heads 60 from withdrawing from apertures 40 and allowing anchor assemblies 23 to become disconnected from one another.

As shown in FIGS. 4 and 5 in particular, the safety hook 24 itself locks the latching levers 54 in their fully latched positions. This is accomplished by virtue of the fact that the hook apertures 44, which align to form a through slot in the abutted plates, are located just above the upper surface of the latching levers 54, when latched. Thus, the latching levers 54 cannot be pivoted out of their fully latched positions once the safety hook 24 is engaged. A slot-shaped aperture 44 is preferred for the hook, as this shape makes it somewhat easier to engage the hook, but a round aperture would also be effective.

Once the anchor subassemblies 23 are latched together the rail engaging portions 36 act together to form a cavity which is sized precisely to permit the appropriate sliding fit with the crown 29 of rail 30, thus requiring no additional adjustments by the workers.

In the most preferred embodiment, the anchor plates are made of ¼ inch thick A36 steel that is zinc coated to resist corrosion. The latching levers are also preferably made using this material. The anchor plates are preferably about six inches long, measured along the longitudinal direction, and about 5 inches tall, after forming. The hook aperture is preferably about 3 inches long in the longitudinal direction and about ½ inch wide. This renders it suitable to accept standard safety hooks or caribiners. The inboard and outboard posts are preferably made from steel. The enlarged heads of both of these posts are preferably 0.750 inch in diameter; and the shoulders of both posts are preferably 0.5 inch in diameter. The shoulder portion of each inboard post is preferably 0.531 inch long, as the shoulder portion of each inboard post must be long enough to extend all the way through the opposing anchor plate and still give room for the opposing latching lever to engage its "head." By contrast, the shoulder portion of each outboard post is preferably only a little over ¼ inch long, since it only needs to be long enough to pivotally support the ¼ inch thick latching lever.

Preferred embodiments of the invention are described above. Those skilled in the art will recognize that other embodiments are possible within the scope of the invention. Variations and modifications of the various parts and assemblies can certainly be made and still fall within the scope of the invention. For example, the term "post" (i.e., when referring to the inboard and outboard posts) used herein is not intended to be limited to any particular type of structure. The term "inboard post" is used simply to refer to any type of operative structural element which is connected to and extends in an inboard direction from the hook engaging portion of the anchor plate, and which is intended to be received by and through a "post receiving aperture" in the hook engaging portion of the opposing anchor plate. And the term "outboard post" is used simply to refer to any type of structure that can, in various embodiments, pivotally secure the latching levers and preferably connect to the associated inboard post with the anchor plate sandwiched therebetween. Thus, while the inboard and outboard posts of the preferred embodiment described herein are roughly in the nature of a shoulder bolt and a corresponding nut, respectively, it is not necessary that they have these configurations in all embodiments as contemplated by the present invention. For example, the inboard and corresponding outboard posts of one of the anchor subassemblies could be welded together rather than threaded together. Or, for that matter, the inboard post needn't be connected to the outboard post at all, given the fact that the function of the outboard post is primarily to act as a pivot point for the latching lever, and the inboard and outboard posts could be connected to the anchor plate in some other fashion as opposed to being threadably connected to one another.

Further with regard to the inboard posts, reference is made above to the latching levers engaging the "heads" of the inboard posts, thus in effect latching the entire anchor assembly together. Actually, as noted above, when the latching levers are pivoted from their unlatched positions to their latched positions notches 57 in the latching levers pivot down onto shoulders 58 of inboard posts 46, or rather the portions of those shoulders that indeed extend all the way through the opposing anchor plate. But, there could be a wide variety of ways in which the latching levers engage the inboard posts, and it is only for convenience that it is stated herein that the latching levers engage the "heads" of the inboard posts. In fact, the inboard posts could be constructed in almost any manner (e.g., having grooves for receiving notches 57 in the latching levers), and it's not necessary that the inboard posts have the more or less shoulder bolt configuration as shown and described herein. Thus, when it is stated herein that the latching levers engage the "heads" of the inboard posts, it is simply meant that the latching levers are engaging a portion of the inboard posts extending all the way through the opposing anchor plates.

Thus, the invention is limited only to the apparatus and method recited in the following claims, and equivalents thereto.

Those skilled in the art will also recognize that the present invention may be described in terms of various methods. In this regard, the present invention also provides a method of securing a fall arrest anchor assembly to an elongate rail, comprising the steps of providing a first anchor member with a longitudinal rail engaging portion, a laterally projecting portion, a receiving portion, and a latching member; providing a second anchor member with a longitudinal rail engaging portion, a laterally projecting portion, a receiving portion, and a latching member; placing the first anchor member and the second anchor member on opposite sides of the rail; moving the first anchor member and the second anchor member toward one another so that each said rail engaging portion engages a respective side of the rail, and the laterally projecting portion of the first anchor member engages the receiving portion on the second anchor member, and the laterally projecting portion on the second anchor member engages the receiving portion on the first anchor member; moving the latching member on the second anchor member to latch the laterally extending portion on the first anchor member relative to the receiving portion on the second anchor member; and moving the latching member on the first anchor member to latch the laterally extending portion on the second anchor member relative to the receiving portion o the first anchor member. The method may further include providing the anchor members with alignable apertures which receive a fastener to prevent unlatching of each said latching member.

Both the foregoing method and the preferred embodiment may be modified and/or enhanced with additional features. For example, the latching members or levers may be spring-biased toward the latched position, and/or stops (one of which is shown as an optional feature in FIG. 5) may be added to the anchor members to limit movement of the latching members. This latter feature requires the latching members to be in their latched positions in order to attach the carabiner or other fastener (otherwise the latching members block the slots in the anchor members).

What is claimed is:

1. A fall arrest anchor assembly suitable for operatively engaging a rail and a fall arrest hook, wherein the anchor assembly comprises a pair of anchor subassemblies each comprising:

(a) an anchor body having a hook engaging portion, a rail engaging portion, an inboard side and an outboard side;

(b) an inboard post connected to the inboard side of the hook engaging portion, the inboard post comprising a head;

(c) an inboard post receiving aperture formed in the hook engaging portion, wherein said inboard post receiving aperture receives the inboard post of the other anchor subassembly when the anchor subassemblies are aligned proximate the rail and laterally moved together; and (d) a latch located on the outboard side of the hook engaging portion, wherein said latch reversibly latches to the inboard post head of the other anchor subassembly, whereby the anchor subassemblies are latched together and the anchor assembly is in sliding engagement with the rail.

2. The anchor assembly of claim 1, wherein the anchor subassemblies are substantially identical to one another.

3. The anchor assembly of claim 1, wherein each anchor subassembly further comprises an outboard post connected to the outboard side of the associated hook attachment portion.

4. The anchor assembly of claim 3, wherein the latch comprises a lever having first and second ends, wherein the lever first end is pivotally connected to the outboard post and the lever second end forms a slot for engaging the inboard post head of the other anchor subassembly.

5. The anchor assembly of claim 3, wherein the outboard post and the inboard post of each anchor subassembly are axially aligned to one another.

6. The anchor assembly of claim 5, wherein the hook attachment portion of each anchor body is apertured to permit the associated inboard and outboard posts to connect to one another with the anchor body sandwiched therebetween.

7. The anchor assembly of claim 1, wherein when the hook is engaged with the hook apertures the latches are locked in engagement with the inboard posts, whereby the anchor subassemblies are locked together.

8. A sliding anchor fall arrest system suitable for engaging a rail, the system comprising a harness that may be worn by a worker; a safety hook; a flexible cable extending between the safety hook and the harness; and an anchor assembly suitable for operatively engaging the rail and the safety hook, wherein the anchor assembly comprises a pair of anchor subassemblies each comprising:

(a) an anchor body having a hook engaging portion, a rail engaging portion, an inboard side and an outboard side;

(b) an inboard post connected to the inboard side of the hook engaging portion, the inboard post comprising a head;

(c) an inboard post receiving aperture formed in the hook engaging portion, wherein said inboard post receiving aperture receives the inboard post of the other anchor subassembly when the anchor subassemblies are aligned proximate the rail and laterally moved together; and (d) a latch located on the outboard side of the hook engaging portion, wherein said latch reversibly latches to the inboard post head of the other anchor subassembly, whereby the anchor subassemblies are latched together and the anchor assembly is in sliding engagement with the rail.

9. A method of securing a fall arrest anchor assembly to an elongate rail, comprising the steps of:

(a) providing a first anchor member with a longitudinal rail engaging portion, a laterally projecting portion, a receiving portion, and a latching member;

(b) providing a second anchor member with a longitudinal rail engaging portion, a laterally projecting portion, a receiving portion, and a latching member;

(c) placing the first anchor member and the second anchor member on opposite sides of the rail;

(d) moving the first anchor member and the second anchor member toward one another so that each said rail engaging portion engages a respective side of the rail, and the laterally projecting portion on the first anchor member engages the receiving portion on the second anchor member, and the laterally projecting portion on the second anchor member engages the receiving portion on the first anchor member;

(e) moving the latching member on the second anchor member to latch the laterally extending portion on the first anchor member relative to the receiving portion on the second anchor member; and (f) moving the latching member on the first anchor member to latch the laterally extending portion on the second anchor member relative to the receiving portion on the first anchor member.

10. The method of claim 9, wherein at least one said anchor member is provided with an aperture, and a fastener is secured through the aperture to prevent movement of at least one said latching member to an unlatched position relative to a respective laterally extending portion.

11. The method of claim 10, wherein each said anchor member is provided with an aperture, and the aperture in the first anchor member aligns with the aperture in the second anchor member, and the fastener is secured through each said aperture to prevent movement of each said latching member to an unlatched position relative to a respective laterally extending portion.

* * * * *